US005192126A

United States Patent [19]

Remeyer et al.

[11] Patent Number: 5,192,126

[45] Date of Patent: Mar. 9, 1993

[54] REMOTE CONTROL FLUORESCENT LANTERN

[75] Inventors: Steven C. Remeyer, Mission Viejo; Rudy B. Meoli, Jr., Placentia, both of Calif.

[73] Assignee: E-Z Sales and Manufacturing, Inc., Gardena, Calif.

[21] Appl. No.: 738,883

[22] Filed: Aug. 1, 1991

[51] Int. Cl.[5] ..... F21L 3/00; F21L 7/00; F21Y 23/00

[52] U.S. Cl. ..... 362/184; 362/186; 362/221; 362/233; 362/260

[58] Field of Search ..... 362/157, 184, 186, 217, 362/221, 225, 233, 260, 297, 298, 346, 363

[56] References Cited

U.S. PATENT DOCUMENTS

| | | | |
|---|---|---|---|
| D. 124,078 | 12/1940 | Reeve | 362/225 |
| 2,216,084 | 9/1940 | Libson | 362/225 |
| 3,767,904 | 10/1973 | Cook | 362/184 |
| 3,767,911 | 10/1975 | Oakley et al. | 362/186 |
| 4,663,687 | 5/1987 | Stearns et al. | 362/260 |
| 4,779,168 | 10/1988 | Montgomery | 362/233 |

*Primary Examiner*—Richard R. Cole

*Attorney, Agent, or Firm*—Chris Papageorge

[57] ABSTRACT

A fluorescent lantern is disclosed which incorporates a radio receiver in its base member. A separate remote control transmitter has a command switch and, in a response to input therefrom, radiates a radio frequency command signal to the receiver. In response to the command signal from the transmitter, the receiver feeds a control signal to a control unit in the base member which operates the fluorescent light tubes, as directed by the command input. The fluorescent lantern, remote control transmitter and receiver are battery powered. The lantern has a pair of reflectors mounted on a lower surface of the base and a lower surface of a top member. The reflectors have convex reflective surfaces to generally reflect light from the fluorescent tubes outwardly from the lantern. A central support rod and fastener secure the lantern base, top member and globe together while allowing manual detachment of the top member to allow access to the fluorescent tubes for removal and installation thereof. A forked bracket rigidly connected to the bracket both retains the fluorescent tubes in their desired operational position and guides the fluorescent tubes into the base to facilitate installation of the fluorescent tubes.

24 Claims, 8 Drawing Sheets

110

162
124
180
120
186
142
140
144
122
114
112
118
132
134
136
193
190
116
192
178
164

REMOTE CONTROL FLUORESCENT LANTERN

BACKGROUND OF THE INVENTION

The present invention relates generally to fluorescent lanterns, and more particularly to a battery powered fluorescent lantern operated via remote control and especially suitable for camping purposes.

Fluorescent lanterns have become increasingly popular over the years due to their substantially lower power requirements in comparison to lanterns utilizing incandescent bulbs. This allows the use of a smaller battery and concomitant smaller size lantern resulting in increased portability. Although gasoline powered camping lanterns are still popular, fluorescent lanterns have taken a considerable market share from gasoline lanterns because fluorescent lanterns do not share the fire hazards inherent in lanterns using combustible fuels. Moreover, fluorescent lanterns do not produce noxious fumes or excess heat as do gasoline lanterns. Nevertheless, there has been a long felt need for an improved fluorescent lantern which provides enhanced illumination while retaining its compact size and lightweight. There has also been a long felt need for a camping lantern which can be turned on and off from a distance so that the camper does not always have to carry the lantern wherever he or she goes.

Some prior art fluorescent lanterns have been specifically designed for ease of fluorescent tube replacement. An example of such a prior art lantern is disclosed in U.S. Pat. No. 4,663,697 to Stearns et al. The Stearns lantern has a top member and a cover detachably secured thereto. The cover contains electrical contacts for the fluorescent tubes, and removal of the cover allows easy access to the fluorescent tubes for ease of replacement thereof. However, the Stearns lantern does not have reflectors designed for providing enhanced illumination and does not have a remote control feature.

Other prior art fluorescent lanterns have been specifically designed for impact resistance. An example of such a prior art lantern is disclosed in U.S. Pat. No. 3,767,904 to Cook. The cook lantern utilizes rectangular reflectors to which the fluorescent tubes are secured to provide a measure of shock absorption to the tubes. The reflectors are positioned so that they are generally behind and parallel to the fluorescent tubes and thus reflect light which is emitted in a direction generally perpendicular to the fluorescent tube axis. However, a primary shortcoming of the Stearns reflectors is that they do not generally reflect light which is emitted in directions nearly parallel to the flurescent tube axis. Moreover, the Cook lantern does not have reflectors mounted on inner surfaces of the top or base members. Consequently, some of the light emitted from the tubes is absorbed by the inner surfaces of the top and base members and thereby wasted. In addition, the Cook lantern, as with the Stearns lantern, does not have a remote control feature.

U.S. Pat. No. 2,653,218 to Schilling et al discloses an electric lantern which has a reflector mounted on an inner surface of the base. However, the Schilling lantern utilizes an incandescent bulb. Thus, the Schilling lantern reflector reflects light coming from a generally point source of light in contrast to the generally line source of light of a fluorescent light tube. Moreover, the Schilling reflector is planar and spaced from the light source so that it reflects much of the light upwardly into the lantern housing where it is absorbed and thereby wasted. In addition, as with the Cook and Stearns lanterns, the Schilling lanterns does not have a remote control feature.

An improved fluorescent lantern is thus needed that has reflectors specially designed to increase the illumination produced by the lantern. An improved fluorescent lantern is also needed that can be operated from a distance in order to provide increased flexibility of use. An improved fluorescent lantern is also needed that has the above features while retaining its relative lightweight and compact size.

SUMMARY OF THE INVENTION

It is a principal object of the present invention to provide a fluorescent lantern providing increased illumination for a given power output.

It is also an object of the present invention to provide a fluorescent lantern having a remote control feature.

It is also an object of the present invention to provide a fluorescent lantern having a remote control system which is entirely battery powered.

It is also an object of the present invention to provide a fluorescent lantern which is relatively lightweight and compact for enhanced portability.

It is also an object of the present invention to provide a fluorescent lantern which is shock resistant.

It is also an object of the present invention to provide a fluorescent lantern which is rugged and durable and thereby specially suited for camping use.

It is also an object of the present invention to provide a fluorescent lantern which is water resistant.

It is also an object of the present invention to provide a fluorescent lantern which can be powered by means of electrical connection to an automobile cigarette lighter socket.

The fluorescent lantern of the present invention includes a base, a globe, a top member and one or more fluorescent light tubes. The ends of the fluorescent tubes are connected to the top member and the base. The base and the top member contain the electrical contacts which connect the fluorescent light tubes to an electrical power source. A support rod is rigidly connected to an upper surface of the base and extends through an inner area of the globe and through the top member. A nut fastened to the top end of the support rod enables the rod and nut to detachably secure the base, globe and top member together. Thus, removing the nut from the threaded top end portion of the support rod allows the top to be detached from the globe and base enabling easy removal and installation of the fluorescent tubes.

A bracket is secured to the support rod. The bracket has end portions which are configured and dimensioned so that they generally abut the fluorescent tubes when the tubes are correctly positioned on and between the top member and the base. Thus, the bracket end portions are designed to both retain the fluorescent tubes in their desired position between the top member and base and to also guide the fluorescent tubes into their desired position during installation thereof.

A pair of reflectors are mounted on inner surfaces of the top member and the base. The reflectors have apertures through which the upper and lower end portions of the fluorescent tubes extend. The reflectors have convex inner surfaces which have a radius of curvature selected so that light rays which are emitted from the fluorescent tubes in generally upward and downward directions are reflected in a generally outward direction approximately perpendicular to the fluorescent tubes axes. Thus, the light rays which would otherwise be emitted onto the inner surfaces of the top member and base and absorbed thereby are instead reflected outwardly from the lantern enabling the lantern to produce a higher degree of illumination.

The lantern of the present invention also includes a remote control which enables the fluorescent light tubes to be turned on and off from a distance. The remote control system includes a radio frequency transmitter which is small enough to be hand held. The transmitter has a manually operated command switch. The remote control system also includes a radio frequency receiver mounted in the base. The receiver is electrically connected to a control switch in the base which in response to control signals from the receiver operates the fluorescent tubes. Consequently, the remote control feature provides the user with the convenience of keeping the lantern in a location where illumination is most desirable and keeping the transmitter in a location where it is most handy. Thus, the user can leave the lantern outside the tent while keeping the transmitter next to his bed at night for handy quick access thereto. This allows the user to turn the light on to scare away wild animals in the campsite area without having to get dressed or leave the tent. Thus, the user does not have to expose himself or herself to potential dangers outside the tent. The remote feature also allows the lantern to be left at the campsite and turned on by remote control when the campers approach the campsite so that the campsite is illuminated prior to entry. In addition, the remote control feature allows the lantern to be placed in a desired location while the camper keeps the remote transmitter handy in preparation for an emergency lights out situation so that the camper can immediately turn on the lights in the event of such an emergency situation.

DETAILED DESCRIPTION OF THE PREFERRED EMBODIMENT

Figure 1:
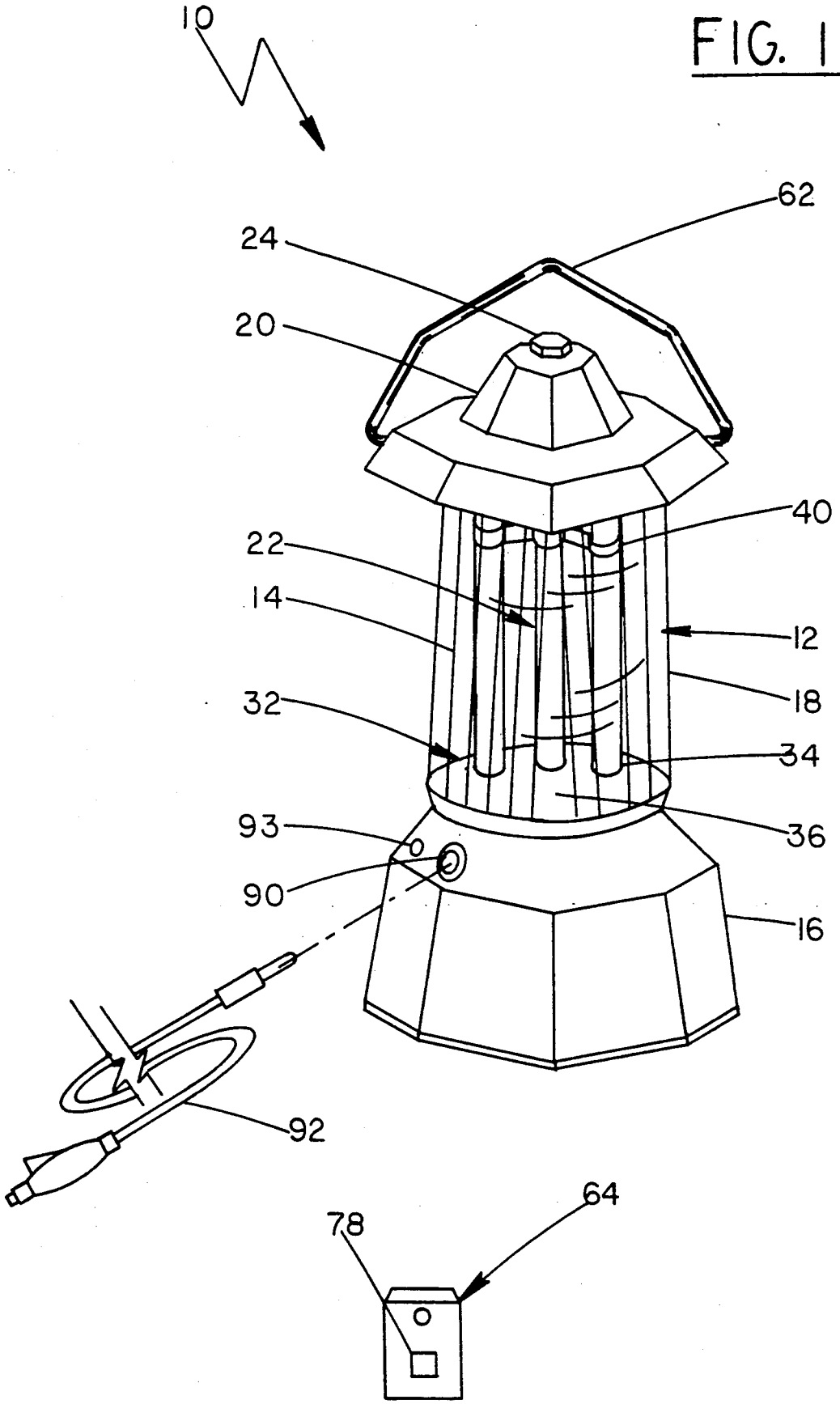
FIG. 1 is a perspective view of a first embodiment of the fluorescent lantern of the present invention showing the main unit of the lantern, the remote control transmitter and the auxiliary power cord.

Referring to the drawings, the fluorescent lantern of the first embodiment of the present invention is generally designated by the numeral 10. The lantern 10 includes a main unit 12 and a remote control unit or transmitter 64. The main unit 12 includes a base 16 on which is mounted a globe 18 and a top member 20 which is mounted on the globe 18, as shown in FIG. 1. The globe 18 is preferably generally a truncated cone. A support means or central support rod 22 is rigidly secured to the base 16 at preferably an upper portion thereof. The support rod 22 extends through an open inner area of the globe 18 and through the top member 20. Support rod 22 preferably has a threaded upper end portion to which is fastened preferably a nut 24 so that support rod 22 and nut 24 can detachably secure base 16, globe 18 and top member 20 together, as shown in FIG. 1.

The main unit 12 has preferably a pair of fluorescent light tubes 26 which are preferably generally vertically mounted within the globe 18 (in the open inner area of the globe 18, as shown in FIG. 1). The axes of the fluorescent tubes 26 are preferably approximately parallel to each other. Sockets 28 mounted on upper surface portions of the base 16 and lower surface portions of the top member 20 receive the upper and lower end portions 30 of the fluorescent tubes 26.

Figure 2:
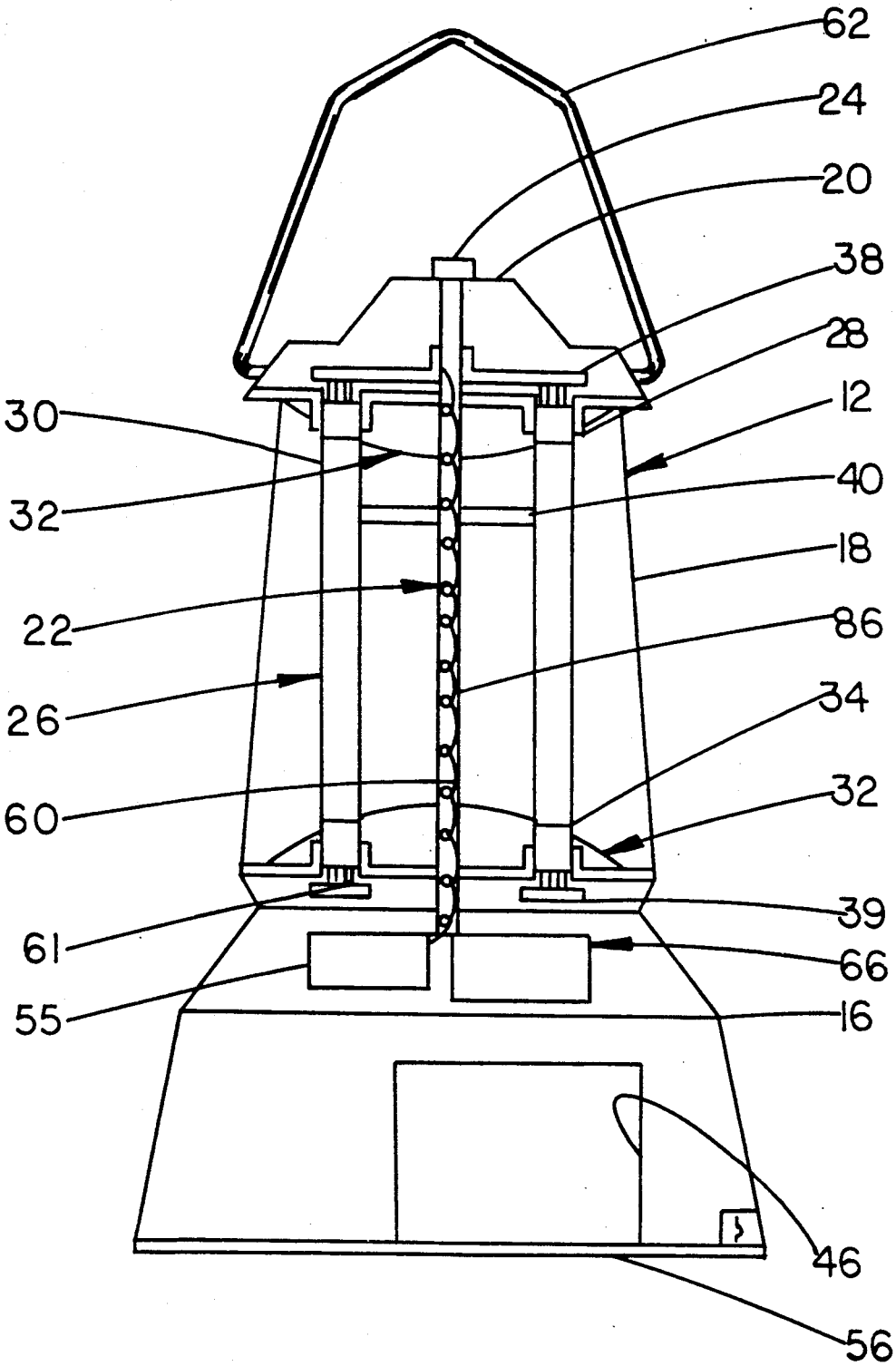
FIG. 2 is a sectional view of the main unit of the fluorescent lantern of the first embodiment of the present invention.
Figure 3:
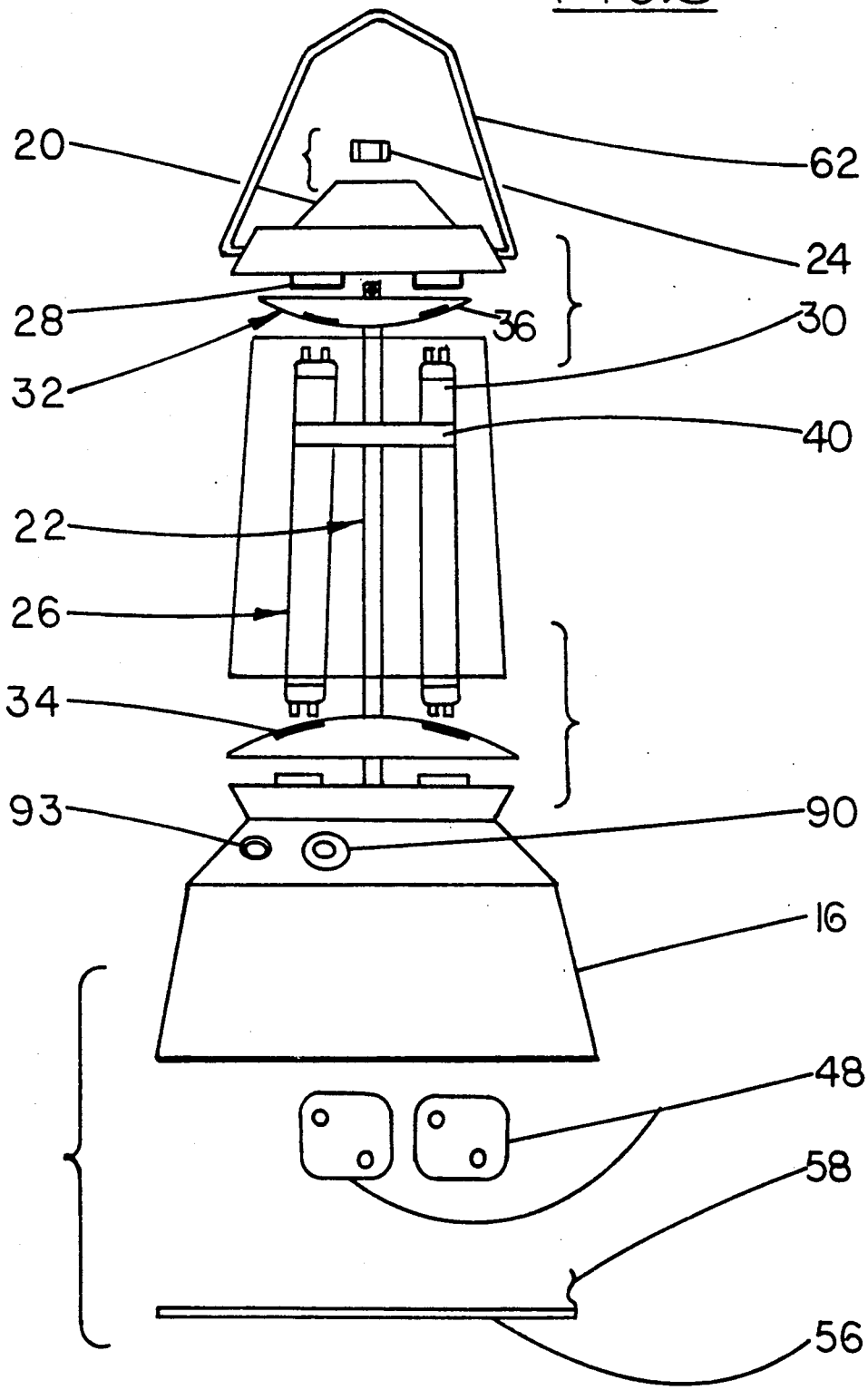
FIG. 3 is an exploded view of the main unit of the fluorescent lantern of the first embodiment of the present invention.
Figure 4:
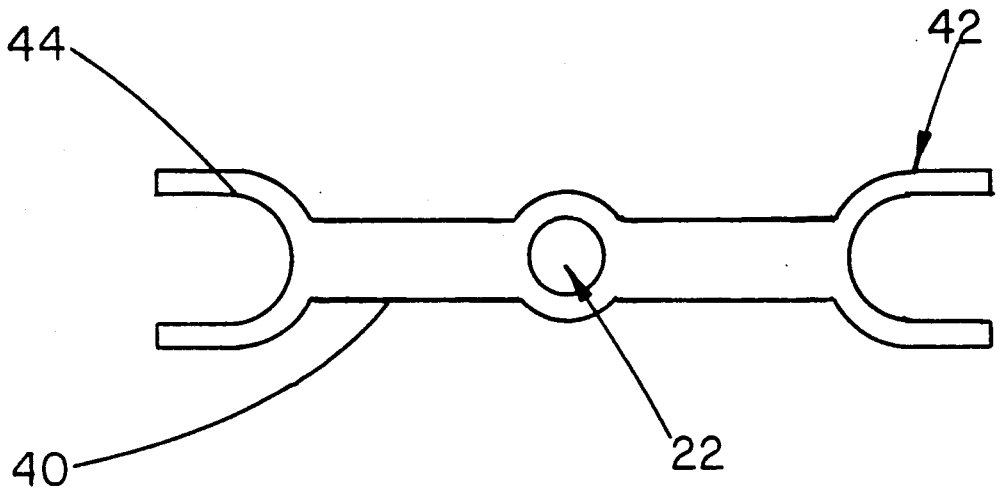
FIG. 4 is a top view of the bracket connected to the support rod of the lantern main unit of the first embodiment of the invention.
Figure 6:
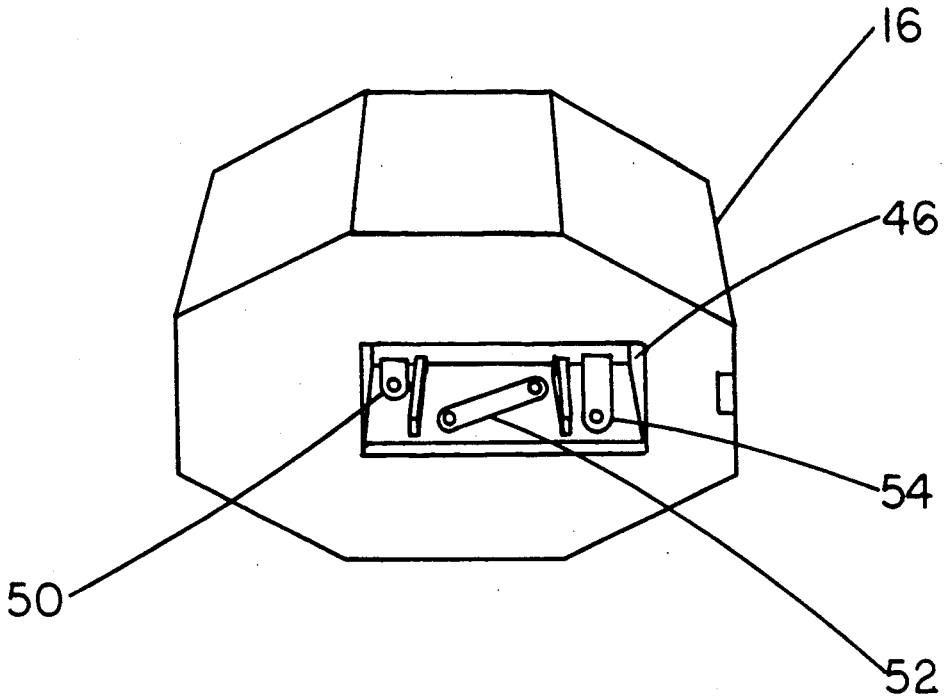
FIG. 6 is a perspective view of the base of the main unit of the fluorescent lantern of the first embodiment of the present invention illustrating the battery compartment and the battery contact plates therein.

The main unit 12 includes preferably a pair of reflectors 32. Reflectors 32 are preferably mounted on the upper surface of the base 16 and on the lower surface of the top member 20 and are preferably positioned approximately adjacent the light tubes 26, as shown in FIG. 2. Each one of the reflectors 32 is preferably provided with a pair of apertures 34. Apertures 34 are preferably located generally over sockets 28 and receive upper end portions 30 of fluorescent tubes 26. The sockets 28 are positioned proximal the apertures 34 so that the apertures are proximal the ends of fluorescent tubes 26 in order that the reflectors 32 can expose generally the entire light emitting surface of the fluorescent tubes 26 to maximize illumination produced by the tubes 26. The reflectors 32 preferably have convex inner surfaces 36 for reflecting light emitted from the fluorescent tubes 26 in an outward direction from the lantern main unit 12. The curvature of the reflectors 32 is selected to direct light impinging on the reflectors 32 in a direction generally perpendicular to the axes of the fluorescent tubes 26. Thus, because the reflectors 32 are generally approximately perpendicular to the axes of the fluorescent tubes 26 and because of the selected curvature of the reflectors 32, light emitted in generally upward and downward directions from the fluorescent tubes 26 is reflected generally outward from the main unit 12. Without these unique reflectors 32, light emitted from the fluorescent tubes 26 in generally upward and downward directions would shine on surface portions of the base 16 and top member 20 where the light would be generally absorbed thereby. Consequently, reflectors 32 reflect light that would otherwise be wasted thereby increasing the illumination provided by the lantern 10 and enhancing its usefulness.

The globe 18 is preferably generally transparent and preferably composed of strong plastic to withstand the rigors of camping. However, the globe 18 may alternatively be translucent and may alternatively also be composed of glass or other suitable material. The globe 18 preferably has vertical lines 14 etched in the outer surface thereof, as shown in FIG. 1. The vertical lines 14 diffuse the light emitted from the lantern main unit 12.

The base 16 and top member 20 are provided with upper electrical contacts 38 and lower electrical contacts 39 to connect fluorescent tubes 26 to an electrical circuit. Upper electrical contacts 38 are preferably located at the upper end portions of the sockets 28 in top member 20. Lower electrical contacts 39 are preferably located at the lower end portions of the sockets 28 in base 16.

A bracket 40 is secured to the support rod 22, preferably at an approximately medial portion thereof, as shown in FIG. 1. The bracket 40 is preferably disposed approximately perpendicular to the rod 22. The bracket 40 has preferably a pair of end portions 42 which are preferably forked. The bracket 40 is dimensioned and positioned so that the gaps between the forks 44 of the end portions 42 are preferably in approximate alignment with the sockets 28, apertures 34 and electrical contacts 38 to allow the forked portions 42 to receive the fluorescent tubes 26 between the forks 44. The forked portions 42 are dimensionally sized so that at least portions of inner surfaces thereof generally abut the fluorescent tubes 26. The bracket 40 thus provides lateral support to the fluorescent tubes 26 and generally retains them in the desired operational position in which they are both secured in the sockets 28 and electrically connected to the electrical contacts 38 and 39.

Figure 5:
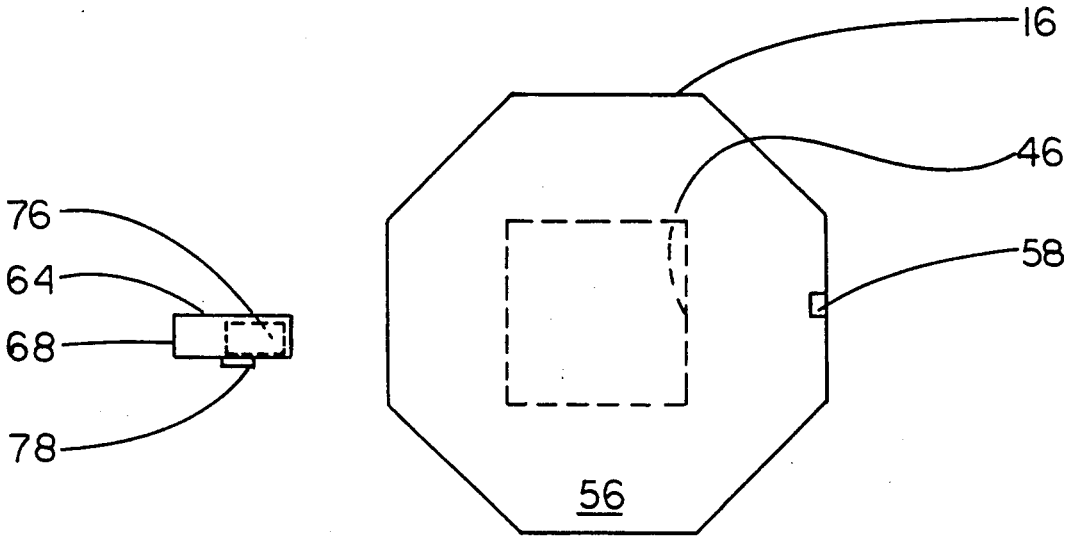
FIG. 5 is a bottom view of the main unit and remote control transmitter of the fluorescent lantern of the first embodiment of the present invention.

The base 16 includes a battery compartment 46 for containing preferably a pair of batteries 48 (See FIGS. 2 and 5). The batteries are preferably six volt batteries connected in series. The battery compartment also has battery contact plates 50, 52 and 54 for connecting the batteries in series to a fluorescent light control subsystem 55 which is mounted in the base 16 preferably above the battery compartment 46. The light control subsystem 55 preferably includes a conventional fluorescent light starter (not shown) and an inverter (not shown) for activation of the fluorescent light tubes 26. At the bottom portion of the base 16 is a cover plate 56 for providing access to the battery compartment. The cover plate 56 has a clip or latch means 58 fitting in a latch recess 59 in the base 16 which allow the base cover plate 56 to be manually secured to the base 16 and close the battery compartment 46.

One of the poles of the batteries 48 is connected to an electrical connector 60. The electrical connector 60 connects the batteries 48 to the electrical contacts 38 in the top member 20 in order to electrically connect the batteries to the contact pins 61 at the upper ends of the fluorescent light tubes 26. The electrical connector 60 is preferably a wire mounted within the preferably hollow central support rod 22. The connector 60 preferably electrically connects the rod 22 to the electrical contacts 38 and to electrical leads (not shown) connected to the battery contact plate 50 or 54 in order to provide connection of an electrical circuit to the fluorescent tubes 26.

The main unit 12 may also be connected to an alternative source of power by means of an adapter cord 92. Adapter cord 92 may be plugged into a cigarette lighter socket (not shown) in an automobile (not shown) to receive power from the automobile battery and plugged into adapter socket 94 in the main unit 12 of the lantern 10 to supply power thereto.

The base 16 and top member 20 are preferably generally octagonally shaped, as shown. The top member 20 also preferably has a handle 62. The lantern main unit 12 (excluding the handle 62) is preferably approximately fifteen inches high and the base 16 is preferably approximately seven inches in width.

The lantern 10 is provided with a remote control system which includes a remote control transmitter 64 and a remote control receiver 66. Components of the transmitter 64 are preferably mounted either in or on a casing 68 which is dimensionally sized so that it can be hand held and preferably dimensionally sized so that it may be carried in a user's shirt or pants pocket. The receiver 66 is preferably mounted in the base 16 and preferably positioned above the battery compartment 46, as shown in FIG. 2. The transmitter 64 preferably includes a pulse code generating means or encoder 72, a dip switch selector 74 connected to the encoder 72, a command switch 78 operably connected to the encoder 72, a modulator 71 connected to the encoder 72 and a rf oscillator 73 connected to the modulator 71. A battery 76 (preferably 9 volts) mounted within the casing 68 supplies electrical power to the components of the transmitter 64. Encoder 72, selector 74, modulator 71, rf oscillator 73 and antenna 70 are also preferably mounted in the casing 68. The command switch 78 is mounted on a face of the casing 68, as shown in FIGS. 1 and 5. The command switch 78 has three positions: one fluorescent light tube on, both fluorescent light tubes on and both fluorescent light tubes off. In operation, the encoder 72 receives command input signals from the command switch 78 which it converts to a coded pulse signal and feeds to a modulator 71 and to a radio frequency oscillator 73 producing a modulated rf signal which is radiated from the antenna 70.

The receiver 66 preferably includes an antenna 80 mounted in the main unit 12. The antenna 80 preferably comprises an electrically conducting portion 86 of the central support rod 22. The length of the portion 86 is preferably selected to maximize reception of the particular frequency of the rf signal transmitted by the transmitter 64. The conducting portion 86 is preferably an outer surface portion of the rod 22 which is preferably electrically insulated from the electrical current conducting connector 60 mounted within the rod 22. The receiver preferably also includes a demodulator 81, pulse decoder 82, a dip switch selector 84 connected to the decoder 82 and a control unit 88 electrically connected to the decoder 82 and operably connected to the fluorescent light tubes via the light control subsystem 55. The control unit 88 may simply be a sequencer or may include one or more suitable relays for turning the fluorescent lights 26 on and off. In operation, the receiver antenna 80 receives the rf signal from the transmitter 64 and feeds the rf signal to the demodulator 81 where the carrier signal is demodulated and fed to the decoder 82 where the coded pulse signal is converted to a control signal which is fed to control unit 88 for operating the fluorescent light tubes 26.

The main unit 12 includes a main switch mounted on an outer surface thereof, as shown in FIG. 1. The main switch 90 is electrically connected to the light control subsystem 55 for manual operation of the fluorescent tubes 26. The main switch 90 also allows remote control operation of the lantern 10 thereby preventing inadvertent remote control operation of the lantern 10. Sequential depression of the main switch 90 sequentially puts the lantern in one of the following states: remote receiver off and one fluorescent tube on, remote receiver activated and both fluorescent tubes on, remote receiver deactivated and both fluorescent tubes off.

Figure 7:
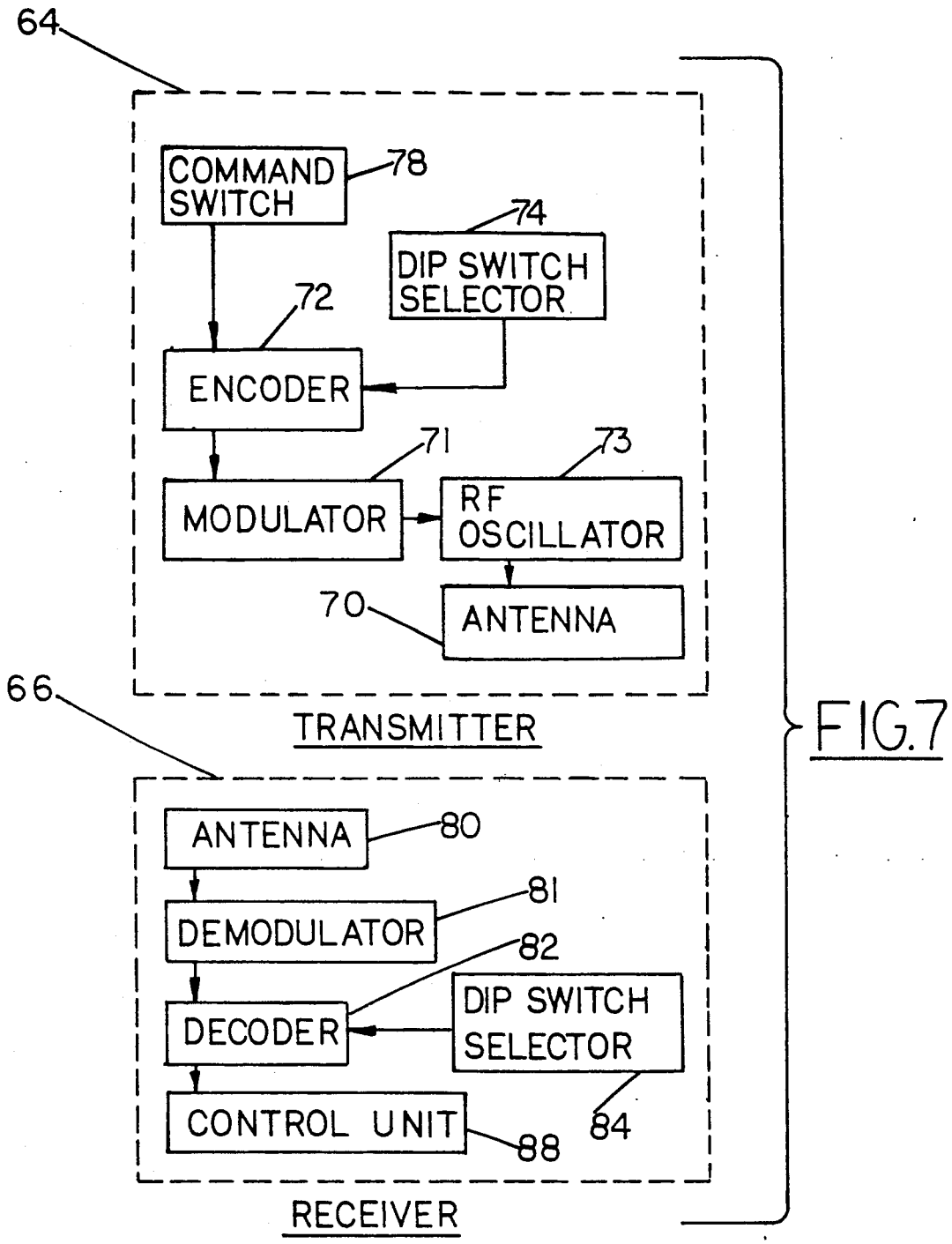
FIG. 7 is a block diagram of the remote control system of the first embodiment of the present invention.
Figure 8:
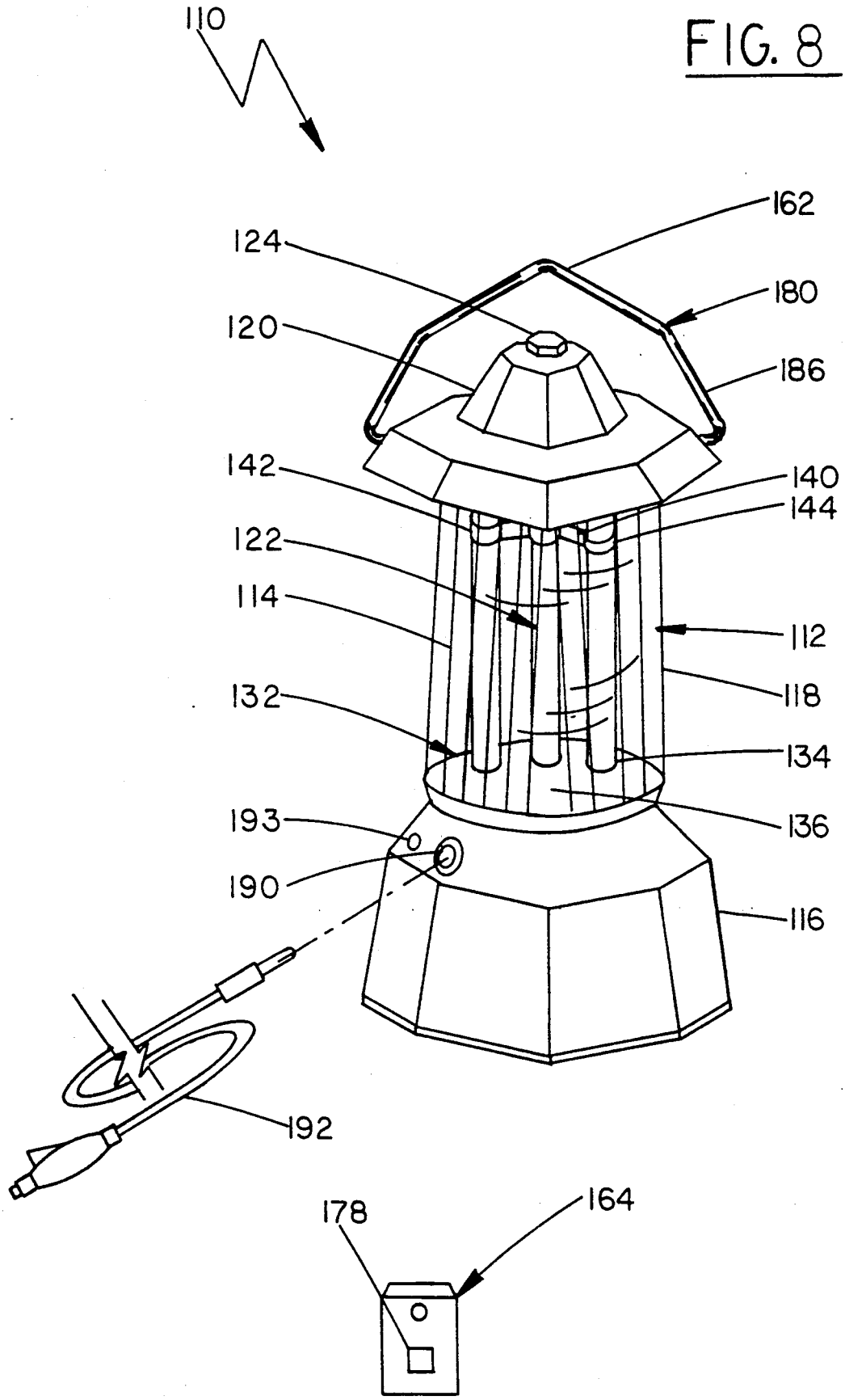
FIG. 8 is a perspective view of a second embodiment of the fluorescent lantern of the present invention, showing the main unit of the lantern, the remote control and the auxiliary cord.
Figure 9:
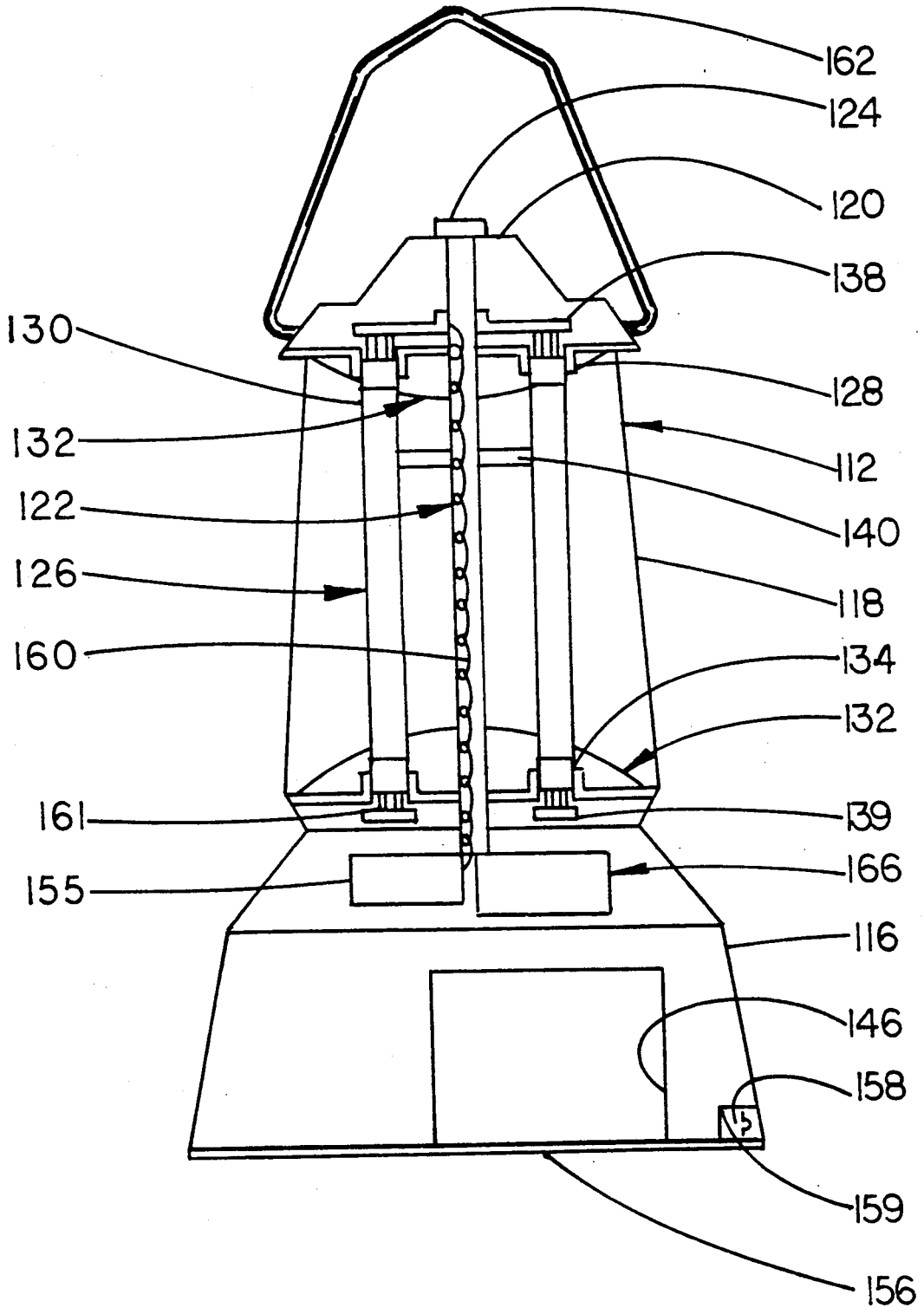
FIG. 9 is a sectional view of the main unit of the second embodiment of the fluorescent lantern of the present invention.

FIGS. 8 and 9 show a second embodiment 110 of the invention. In the second embodiment 110, an electrically conducting portion 186 of the handle 162 is utilized as an antenna 180 for the receiver 166. In embodiment 110, center support rod 122 is preferably electrically conducting in order to electrically interconnect upper electrical contacts 138 to a suitable one of the pairs of the battery contact plates 150. However, center support rod 122 may also be hollow for containing a wire therein for electrically interconnecting contacts 138 and plates 150, as with connector 60 of embodiment 10. In all other respects, embodiment 110 is identical to embodiment 10. Embodiment 110 includes main unit 112, base 116 and globe 118 having vertical lines 114 etched thereon. Embodiment 110 also includes top member 120, nut 124, light tubes 126, sockets 128, tube upper end portions 130, reflectors 132, reflector apertures 134, reflector convex surfaces 136, lower electrical contracts 139, bracket 140 having forked portions 142 and forks 144, battery compartment 146, batteries 148, battery contact plates 150, 152, 154, light control subsystem 155, base plate 156, latch 158, recess 159, contact pins 161, handle 162, transmitter 164, receiver 166, transmitter casing 168, main switch 190, cord 192 and socket 193 which are identical to the correspondingly numbered components of embodiment 10 so their description will not be repeated. In addition, transmitter 164 and receiver 166 have components which are identical in all other respects to components of transmitter 64 and receiver 66 of embodiment 10 described in preceeding paragraphs and shown in block diagram in FIG. 7 so their descriptions and depictions will not be repeated. Accordingly, there has been provided, in accordance with the invention, a fluorescent lantern which has remote control capabilities and which provides increased illumination for a given power input. It is to be understood that all the terms used herein are descriptive rather than limiting. Although the invention has been described in conjunction with the specific embodiment set forth above, many alternative embodiments, modifications, and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

We claim:

1. A portable fluorescent lantern, comprising:

a globe;

a top member mounted on a top portion of said globe;

a base for supporting said globe and said top, said globe mounted on said base;

means for detachably securing said base, said globe and said top together;

a fluorescent light mounted within said globe;

a bracket secured to said means for detachably securing, said bracket dimensioned and positioned so that a portion thereof is adjacent a generally medial portion of said fluorescent light when said light is operationally positioned within said globe in order to facilitate operational positioning of said fluorescent light within said globe and to retain said fluorescent light in its operational position within said globe by providing lateral support thereto;

an upper electrical contact means mounted in said top member for connecting an electric circuit to an upper end of said fluorescent light;

a lower electrical contact means mounted in said base for connecting an electric circuit to a lower end of said fluorescent light.

2. The portable lantern of claim 1 wherein the portion of said bracket includes a generally forked portion having inner surfaces which generally abut the medial portion of said fluorescent light.

3. The portable lantern of claim 2 wherein the forked portion has a gap therebetween which is generally in alignment which said upper and lower electrical contacts.

4. The portable lantern of claim 1 further including a reflector mounted within said globe at an end portion thereof.

5. The portable lantern of claim 4 wherein said reflector is positioned so that the axis of said fluorescent light is approximately perpendicular to said reflector.

6. The portable lantern of claim 4 wherein said reflector is positioned approximately adjacent said fluorescent light.

7. The portable lantern of claim 4 wherein said reflector is mounted on an inner surface of said top.

8. The portable lantern of claim 2 wherein said reflector is mounted on an inner surface of said base.

9. The portable lantern of claim 1 wherein said means for detachably securing includes:

a central support member connected to said base and extending from said base through said top and through an inner area of said globe; and a fastener removably secured to an upper end portion of said central support member for detachably securing said top, said base and said globe together.

10. The portable lantern of claim 1 wherein said base includes a battery compartment for containing an electrical battery therein.

11. The portable lantern of claim 1 further including an electrical connector for connecting said battery to said upper and lower electrical contacts.

12. The portable lantern of claim 1 further including:

an upper socket in said top for receiving an upper end portion of said fluorescent light; and a lower socket in said base for receiving a lower end portion of said fluorescent light, said upper and lower sockets in approximate alignment with said upper and lower electrical contacts.

13. The portable lantern of claim 12 wherein:

said fluorescent light is a pair of fluorescent lights;

said upper socket is a part of upper sockets, each of said pair of upper sockets receiving an upper end portion of one of said pair of fluorescent lights;

said lower socket is a pair of lower sockets, each of said pair of lower sockets receiving a lower end portion of one of said pair of fluorescent lights.

14. The portable lantern of claim 1 further including a remote control system for remote manual operation of said fluorescent light.

15. The portable lantern of claim 14 further including a main switch mounted on said base for manual operation of both said remote system and said fluorescent light.

16. The portable lantern of claim 14 wherein said remote system includes:

a radio frequency transmitter;

a radio frequency receiver for receiving radio signals from said transmitter and converting said radio signals into control signals, said receiver mounted in said base.

17. A portable fluorescent lantern, comprising:

a globe;

a top member mounted on a top portion of said globe;

a base for supporting said globe and said top, said globe mounted on said base;

means for detachably securing said base, said globe and said top together;

a fluorescent light mounted within said globe;

a bracket secured to said means for detachably securing, said bracket dimensioned and positioned so that a portion thereof is adjacent said fluorescent light when said light is operationally positioned within said globe in order to facilitate operational positioning of said fluorescent light within said globe and to retain said fluorescent light in its operational position within said globe by providing lateral support thereto;

an upper electrical contact means mounted in said top member for connecting an electrical circuit to an upper end of said fluorescent light;

a lower electrical contact means mounted in said base for connecting an electric circuit to a lower end of said fluorescent light;

a reflector mounted within said globe at an end portion thereof, said reflector having a generally convex reflective surface in order to enhance reflection of light emitted from said fluorescent light generally outwardly from said globe.

18. A portable fluorescent lantern, comprising:

a globe;

a top member mounted on a top portion of said globe;

a base for supporting said globe and said top, said globe mounted on said base;

means for detachably securing said base, said globe and said top together;

a fluorescent light mounted within said globe;

a bracket secured to said means for detachably securing, said bracket dimensioned and positioned so that a portion thereof is adjacent said fluorescent light when said light is operationally positioned within said globe in order to facilitate operational positioning of said fluorescent light within said globe and to retain said fluorescent light in its operational position within said globe by providing lateral support thereto;

an upper electrical contact means mounted in said top member for connecting an electrical circuit to an upper end of said fluorescent light;

a lower electrical contact means mounted in said base for connecting an electric circuit to a lower end of said fluorescent light;

a reflector mounted within said globe at an end portion thereof, said reflector having an opening for receiving said fluorescent light, said opening in approximate alignment with said upper and lower electrical contacts in order to facilitate proper positioning of said fluorescent light within said globe.

19. A portable fluorescent lantern, comprising:

a globe;

a top member mounted on a top portion of said globe;

a base for supporting said globe and said top, said globe mounted on said base;

means for detachably securing said base, said globe and said top together;

a fluorescent light mounted within said globe;

a bracket secured to said means for detachably securing, said bracket dimensioned and positioned so that a portion thereof is adjacent said fluorescent light when said light is operationally positioned within said globe in order to facilitate operational positioning of said fluorescent light within said globe and to retain said fluorescent light in its operational position within said globe by providing lateral support thereto;

an upper electric contact means mounted in said top member for connecting an electrical circuit to an upper end of said fluorescent light;

a lower electrical contact means mounted in said base for connecting an electric circuit to a lower end of said fluorescent light;

a pair of reflectors mounted within said globe at end portions thereof, said pair of reflectors positioned so that convex surfaces thereof are generally facing each other.

20. A portable fluorescent lantern, comprising:

a globe;

a top member mounted on a top portion of said globe;

a base for supporting said globe and said top, said globe mounted on said base;

means for detachably securing said base, said globe and said top together;

a fluorescent light mounted within said globe;

a bracket secured to said means for detachably securing, said bracket dimensioned and positioned so that a portion thereof is adjacent said fluorescent light when said light is operationally positioned within said globe in order to facilitate operational positioning of said fluorescent light within said globe and to retain said fluorescent light in its operational position within said globe by providing lateral support thereto;

an upper electrical contact means mounted in said top member for connecting an electrical circuit to an upper end of said fluorescent light;

a lower electrical contact means mounted in said base for connecting an electric circuit to a lower end of said fluorescent light;

a remote control system for remote manual operation of said fluorescent light, said remote system including a radio frequency transmitter having a coded pulse generating means for receiving manual command input from said command switch and converting the command input to a coded pulse signal, said transmitter having a modulator for combining the coded pulse signal with a rf carrier signal and a transmitting antenna for transmitting the modulated rf signal, said remote system including a radio frequency receiver for receiving radio signals from said transmitter and converting said radio signals into control signals, said receiver mounted in said base, said receiver including a receiving antenna for receiving the modulated rf signal from said transmitter, said receiving antenna integral with said means for detachably securing, said receiver including a demodulator for demodulating the rf signal to produce a coded pulse output, said receiver including a decoder for converting the code pulse output into a control signal and a control unit for receiving the control signal and operating said fluorescent light in response thereto.

21. A portable fluorescent lantern, comprising:

a globe;

a top member mounted on a top portion of said globe;

a base for supporting said globe and said top, said globe mounted on said base;

means for detachably securing said base, said globe and said top together;

a fluorescent light mounted within said globe;

a bracket secured to said means for detachably securing, said bracket dimensioned and positioned so that a portion thereof is adjacent said fluorescent light when said light is operationally positioned within said globe in order to facilitate operational positioning of said fluorescent light within said globe and to retain said fluorescent light in its operational position within said globe by providing lateral support thereto;

an upper electrical contact means mounted in said top member for connecting an electrical circuit to an upper end of said fluorescent light;

a lower electrical contact means mounted in said base for connecting an electric circuit to a lower end of said fluorescent light;

a remote control system for manual operation of said fluorescent light, said remote system including a radio frequency transmitter having a coded pulse generating means for receiving manual command input from said command switch and converting the command input to a coded pulse signal, said transmitter having a modulator for combining the coded pulse signal with a rf signal and a transmitting antenna for transmitting the modulated rf signal, said remote system including a radio frequency receiver for receiving radio signals from said transmitter and converting said radio signal into control signals, said receiver mounted in said base, said receiver including a receiving antenna for receiving the modulated rf signal from said transmitter, said receiver including a demodulator for demodulating the rf signal to produce a coded pulse output, said receiver including a decoder for converting the coded pulse output into a control signal and a control unit for receiving the control signal and operating said fluorescent light in response thereof;

a handle connected to said top member, said handle integral with said receiving antenna.

22. A portable fluorescent lantern, comprising:

a globe;

a top member mounted on a top portion of said globe;

a base for supporting said globe and said top, said globe mounted on said base;

means for detachably securing said base, said globe and said top together;

a fluorescent light mounted within said globe;

a bracket secured to said means for detachably securing, said bracket dimensioned and positioned so that a portion thereof is adjacent said fluorescent light when said light is operationally positioned within said globe in order to facilitate operational positioning of said fluorescent light within said globe and to retain said fluorescent light in its operational position within said by providing lateral support thereto;

an upper electrical contact means mounted in said top member for connecting an electrical circuit to an upper end of said fluorescent light;

a lower electrical contact means mounted in said base for connecting an electric circuit to a lower end of said fluorescent light;

a remote control system for remote manual operation of said fluorescent light; said remote system including a receiving antenna for receiving a rf signal, said antenna being integral with said means for detachably securing.

23. A portable fluorescent lantern, comprising:

a globe;

a top member mounted on a top portion of said globe;

a base for supporting said globe and said top, said globe mounted on said base;

means for detachably securing said base, said globe, and said top together;

a fluorescent light mounted within said globe;

a bracket secured to said means for detachably securing, said bracket dimensioned and positioned so that a portion thereof is adjacent said florescent light when said light is operationally positioned within said globe in order to facilitate operational positioning of said florescent light within said globe and to retain said fluorescent light in its operational position within said globe by providing lateral support thereto;

an upper electrical contact means mounted in said top member for connecting an electrical circuit to an upper end of said fluorescent light;

a lower electrical contact means mounted in said base for connecting an electric circuit to a lower end of said fluorescent light;

a remote control system for remote manual operation of said fluorescent light, said remote system including a receiving antenna;

a handle connected to said top member, said handle integral with said receiving antenna.

24. A portable fluorescent lantern, comprising:

a globe;

a top member mounted on a top portion of said globe;

a base for supporting said globe and said top, said globe mounted on said base;

means for detachably securing said base, said globe and said top together, said means including a central support member connected to said base and extending from said base through said top and through an inner area of said globe;

a fluorescent light mounted within said globe;

a bracket secured to a generally medial portion of said central support member, said bracket generally perpendicular to said central support member, said bracket dimensioned and positioned so that a portion thereof abuts a generally medial portion of said fluorescent light when said light is operationally positioned within said globe in order to facilitate operational positioning of said fluorescent light within said globe and to retain said fluorescent light in its operational position within said globe by providing lateral support thereto;

an upper electrical contact means mounted in said top member for connecting an electric circuit to an upper end of said fluorescent light;

a lower electrical contact means mounted in said base for connecting an electric circuit to a lower end of said fluorescent light.

* * * * *